US006715560B2

(12) United States Patent
Doane et al.

(10) Patent No.: US 6,715,560 B2
(45) Date of Patent: Apr. 6, 2004

(54) COLLET-CONE SLIP SYSTEM FOR RELEASABLY SECURING WELL TOOLS

(75) Inventors: James Christopher Doane, Friendswood, TX (US); Hector Hugo Mireles, Spring, TX (US); Conrad Gustave Weining, Missouri City, TX (US)

(73) Assignee: Baker Hughes Incorporated, Houston, TX (US)

( * ) Notice: Subject to any disclaimer, the term of this patent is extended or adjusted under 35 U.S.C. 154(b) by 73 days.

(21) Appl. No.: 09/797,436

(22) Filed: Mar. 1, 2001

(65) Prior Publication Data

US 2002/0121380 A1 Sep. 5, 2002

(51) Int. Cl.[7] ..... E21B 33/12; E21B 23/00

(52) U.S. Cl. ..... 166/387; 166/381; 166/382; 166/122

(58) Field of Search ..... 166/120, 121, 166/122, 124, 381, 382, 387

(56) References Cited

U.S. PATENT DOCUMENTS

| | | | | |
|---|---|---|---|---|
| 3,303,885 A | | 2/1967 | Kisling, III et al. | 166/134 |
| 3,631,925 A | | 1/1972 | Nutter | 166/134 |
| 4,216,827 A | * | 8/1980 | Crowe | 166/120 |
| RE31,978 E | | 9/1985 | McStravick | 166/387 |
| 4,582,135 A | | 4/1986 | Akkerman | 166/134 |
| 4,688,634 A | | 8/1987 | Lustig et al. | 166/120 |
| 4,765,404 A | | 8/1988 | Bailey et al. | 166/117.6 |
| 5,048,613 A | | 9/1991 | Shilling | 166/387 |
| 5,390,737 A | | 2/1995 | Jacobi et al. | 166/184 |
| 5,620,050 A | | 4/1997 | Barbee | 166/278 |
| 5,701,954 A | | 12/1997 | Kilgore et al. | 166/119 |
| 5,701,959 A | | 12/1997 | Hushbeck et al. | 166/387 |
| 5,720,343 A | | 2/1998 | Kilgore et al. | 166/120 |
| 5,944,102 A | | 8/1999 | Kilgore et al. | 166/119 |
| 6,112,811 A | | 9/2000 | Kilgore et al. | 166/134 |
| 6,119,774 A | | 9/2000 | Doane et al. | 166/134 |

OTHER PUBLICATIONS

Combined Search and Examination Report under Sections 17 and 18(3) for GB 0305469.9.

* cited by examiner

*Primary Examiner*—David Bagnell
*Assistant Examiner*—Brian D Halford
(74) *Attorney, Agent, or Firm*—Madan, Mossman & Sriram, P.C.

(57) ABSTRACT

A selectively released well tool anchor has a tubular wicker shoe cage and a tubular setting sleeve in sliding assembly over a tubular mandrel. The wicker shoe cage confines a plurality of independent wicker shoes. The tubular setting sleeve has a conical slip face that is loosely meshed with the shoe cage by a plurality of collet fingers extended from the conical slip face into meshed engagement with detents in the shoe cage. The collet fingers are secured within the detents for well run-in by calibrated shear fasteners. An axial translation of the setting sleeve toward the shoe cage by shearing the fasteners displaces the wicker shoes outwardly for inside wall penetration. The wicker shoes are disengaged from the wall by axial translation of the cage from the sleeve to engage mutual abutment faces on the cage and shoes.

13 Claims, 9 Drawing Sheets

64
69
74
70
76
75
72
88
80
82
84
15
62
66
68
77
49
47
45
46
89
48
86
12

16
17
37
14
41
40
52
43
55
56
57
50
54
19
T
69
58
68
64
60
62
66
12
30
15

20
15
129
25
33
32
35
34
30
26
127
31
12

15
24
27
25
129
33
26
127
12

15
26
34
30
16
12

10
12
11
13
15
20
21
22
24
25
26
27
C

COLLET-CONE SLIP SYSTEM FOR RELEASABLY SECURING WELL TOOLS

BACKGROUND OF THE INVENTION

1. Field of the Invention

The present invention relates to methods and apparatus for producing valuable minerals from the earth. More particularly, the invention relates to an apparatus and method for setting pipe anchors to secure the position of downhole well tools such as annulus packers and subsequently releasing the tool for removal from the well.

2. Description of Related Art

Downhole well tools most commonly used to secure pipe or another tool such as an annulus packer to the inside wall of a wellbore casing are frequently characterized as "slips". Characteristically, a slip comprises a plurality of radially expansible elements known to the art as a "wickers." Traditionally, a plurality of wickers are distributed circumferentially around a cylindrical mandrel. By some means, the wickers are longitudinally secured to the mandrel, but radially free to at least limited expansion from the mandrel outside diameter. The inside wall engagement surfaces of a wicker are serrated with numerous penetrating tooth points or parallel rows of cutting edges. The wicker teeth or edges are of extremely hard material and are cut sharply for penetration into the steel casing wall surface. The wicker underside is ramped to cooperate with a conical slip face. The conical slip face is a circumferential surface on a tubular sleeve. By one of various means, the tubular sleeve is displaced axially along the mandrel surface relative to the longitudinally fixed wicker to wedge the conical slip face under the wicker and against the underside ramp. As the conical slip face advances axially along the mandrel, the wicker body is forced radially outward to press the serrated tooth edges into the inside wall of the casing thereby clamping the wickers and mandrel to the casing, for example. The mandrel is frequently secured to a tubular workstring such as production tubing or drill pipe but may also be wireline deployed.

Slips used in conjunction with annulus packers are frequently arranged in pairs. One or more slip sets are above the packer and one or more are below the packer. Distinctively, the wickers of the respective slips are biased in opposite directions. For example, the bottom wickers may be biased to cut more deeply into the casing wall if uploaded. Cooperatively, the upper slips may be biased to cut more deeply into the casing wall if downloaded. Hence, longitudinal movement of the packer along the casing bore, for example, is resisted in both directions. However, utility of this nature requires that the several tools be deployed sequentially. For example, a packer unit may comprise four distinct tools: (1) a debris barrier, (2) an upper slip set, (3) a lower slip set, and (4) a packer sleeve. When the packer unit is located at the desired setting position, a predetermined deployment sequence may require that the debris barrier is first deployed. Next, the procedure may specify engagement of the upper slip set to anchor the unit to the casing wall in support of the workstring weight. Third, the packer sleeve is inflated/expanded radially outward to pressure seal the annulus between the inside casing wall and the outer tool string wall. Finally, the lower slip is set to oppose any possible downhole pressure lifting of the work or production string.

Should, by error or accident, either or both slips be set prematurely, the location of the packer may be incorrect or the integrity of the packer seal may be compromised. To mechanically order the deployment sequence of slips and other well tools, mechanisms such a shear pins, shear rings, keys and J-slots have been used with limited success. However, these devices require that a channel of one form or another be cut into the tool mandrel to such depth as to encroach upon the ultimate tool strength. For example, a shear ring groove turned into the tubular wall of a slip mandrel may reduce the cross-sectional diameter by as much as 0.200 in. When translated to the loss of mandrel tensile strength, this 0.200 in. is significant.

In some cases, it is necessary to recover the tools set by a multiple step sequence. In those cases, recovery requires that the sequence be substantially repeated in the same order as that required by the setting.

SUMMARY OF THE INVENTION

An object of the present invention, therefore, is a slip setting system that may be sequenced into and out of well or pipe wall engagement.

Another object of the invention is a slip system that may be selectively programmed for the order of tool engagement and disengagement.

Also an object of the invention is provision of collet fingers on a slip actuating cone to prevent the slip from prematurely setting.

Another object of the invention is a mechanical connection between collet fingers from a slip cone and a slip cage that allows the cone and cage to move together during retrieval but to separate against a calibrated shear fastener when set.

A further object of the invention is provision of a retreivable packer system.

An additional object of the invention is a method and apparatus for releasing a downhole pipe anchor.

A further object of the invention is a method and apparatus for rectifying movement of a packer slip element along the packer mandrel.

These and other objects of the invention as will become evident from the following description of the preferred invention embodiments are served and accomplished by a well wall anchor having a reversible deployment mechanism. The well anchor comprises a tubular wicker shoe cage having a sliding fit over a tubular tool mandrel. The shoe cage has plurality of shoe retaining slots around the cage circumference for retaining a plurality of wicker shoes. A conical slip face is carried by an anchor actuating sleeve having collet fingers projecting axially from the slip face. The collet fingers are secured to the cage by calibrated shear pins that fail within a relatively narrow but predetermined load range. The anchor wicker shoes include retainer blocks that mesh with the shoe retaining lots in the shoe cage. An inside surface of the wicker shoes, opposite from the wicker teeth, is ramped to serve as a slip face. The wicker shoe slip face is aligned in juxtaposition with the conical slip face. The shear pins fail upon sufficient axial compression between the collet sleeve and the wicker shoe cage. The wicker expansion cone may advance against the wicker ramps to expand the wicker shoes radially for engagement of the wicker teeth with the well casing wall.

The combination packer and anchor is assembled over a tubular mandrel having two fixed reference structures. The upper reference structure is the mounting collar for a debris barrier. The second reference structure is a ring piston that is structurally secured to the mandrel. The radially expansible elements comprising a debris barrier, the packer sealing sleeve and upper and lower slip anchors are operatively slidable over the mandrel between the two reference structures.

The ring piston cooperates with a double acting cylinder to axially compress the radially expandable elements of the packer. Well string bore pressure applied through a mandrel orifice into a cylinder having the ring piston as one head and a mandrel slide ring as the other head drives the cylinder against the expandable packer elements. The expandable elements are consequently compressed against the upper reference structure and expanded. These elements expand sequentially in a predetermined order as determined by calibrated shear fasteners and the relative dimensions of axial shift channels. First, the debris barrier expands to shield the lower tools from additional debris interference. Next, the upper anchor is expanded when the calibrated shear fastener between the wicker shoe cage and the actuating sleeve fails. As the wicker shoes expand and the wicker points penetrate the well wall, the compressive load along the mandrel is transferred to the well wall. Subsequently, the expandable seal sleeves of the packer are extended against the well walls. Finally, the calibrated shear fastener between the wicker shoe cage and the actuating sleeve for the lower anchor fails resulting in the lower anchor set.

For collapse of the expandable elements and removal of the packer from the well, the mandrel is cut by any of well known means. Initially, following the cut of the mandrel, tension is drawn on the workstring from the surface to the effect of sliding the uphole portion of the cut mandrel under the anchors and packer. However, the anchor collar of the debris barrier is secured to the mandrel surface and does not slide. Hence, the upper end of the debris barrier sleeve is retracted from the well wall as the anchor collar is displaced axially from the downhole compression collar.

At the location where the debris barrier sleeve is completely retracted, the compression collar engages and abutment surface of the limit ring that is secured to the mandrel. The compression collar is rigidly secured to the upper caging ring and therefore draws the caging ring with it. In turn, limit walls on the wicker shoe retaining slots engage the wicker shoe blocks. Further uphole movement of the mandrel draws the uphole wicker shoes off the conical slip face thereby permitting the shoes to withdraw from engagement with the well wall.

The caging ring also engages the retaining blocks on the collet fingers to pull the collet sleeve and attached compression cup away from the packer seal assembly thereby decompressing the packer seal.

Further uphole displacement of the mandrel brings a section of buttress threads on the mandrel surface into engagement with meshing buttress threads on the collet cone sleeve for the lower anchor. Such meshing provides a positive engagement pick-up on the sleeve thereby pulling the conical slip face away from the lower wicker shoe slip face. Hence, the lower anchor disengages from the well wall. The packer and anchor assembly may now be removed from the well or repositioned to a different depth.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DESCRIPTION OF THE PREFERRED EMBODIMENTS

Figures 1A, 2A, 3A:
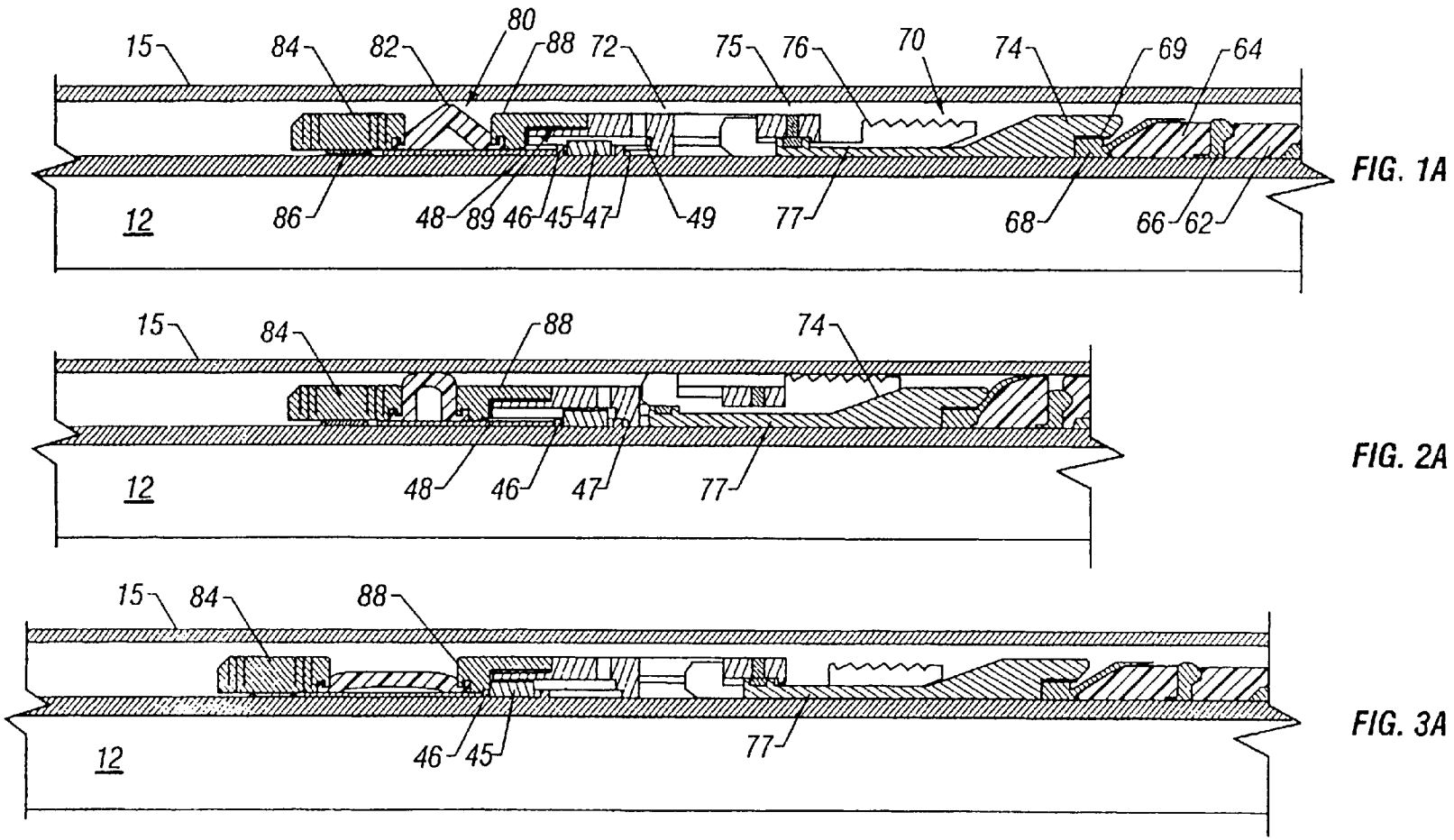
FIGS. 1A through 1D illustrate, in axial quarter section, the invention in operative assembly as it is initially lowered into a wellbore and before actuation of any elements.
FIGS. 2A through 2D illustrate, in axial quarter section, the invention in operative assembly as it is actuated to set the packer sealing sleeve and the anchor wickers.
FIGS. 3A through 3D illustrate, in axial quarter section, the invention in operative assembly as it is actuated to remove the assembly from sealing sleeve and anchor wickers from the well.

The invention is disclosed and described herein in the preferred embodiment context of a combined wellbore packer and workstring anchor. In this embodiment, both tools are activated hydraulically and deactivated mechanically. FIGS. 1 through 3 Illustrate the invention in axial quarter section and in four axially broken segments. For the present purposes, the left edge of the drawing frame is taken as the uphole reference direction. Accordingly, FIG. 1D illustrates the bottom-hole interface between the present tool mandrel 12 and the well work string of pipe 10 below the mandrel 12. FIGS. 1A through 1D illustrate the assembly in the Arun-in@ state with the wellbore anchors and packer sleeve retracted. FIGS. 2A through 2D illustrate the Aset@ status of the anchors and packer. FIGS. 3A through 3D illustrate the deactivated status of the tool elements as they would be when the tools are withdrawn from the well.

With initial reference to the tool bottom and the work string 10 interface as best illustrated by FIG. 1D, the tool mandrel 12 is assembled by threads 13 to the work string box sleeve 11. Also secured to the work string box sleeve 11 by assembly threads 21 is a lower cylinder wall 20. The cylinder wall 20 extends upwardly from the box sleeve 11 and concentrically around the lower end of the mandrel 12 to confine a smooth wall, annular space 24 between the inside surface of the wall 20 and the outside surface of the mandrel 12. Near the box sleeve 11, the mandrel is perforated by one or more fluid flow orifices 22 for transfer of fluid pressure from within the mandrel center bore into the annular space 24.

Additional features of the mandrel 12 include an external ring piston 16 secured to the mandrel O.D. by assembly threads 17. On the uphole side of the ring piston 16, the mandrel wall is again perforated by fluid flow orifices 14. At the upper end of the mandrel 12 is a debris barrier 80 secured to the mandrel O.D. by assembly threads 86 between the mandrel 12 and an anchor collar 84. At carefully selected position between the anchor collar 84 and the ring piston 16, is a circumferential band of buttress thread 19 having a thread length T along the mandrel length. The buttress thread 19 depth is preferably as shallow as the specific application will allow for intrusion of annulus section thickness. Those of skill in the art know that in many cases, the ultimate tensile strength of the tool is determined by the undisturbed section thickness of the mandrel at this point. As a representative example, therefore, the buttress threads may only be about 0.017 in. deep into the outer surface of the mandrel. A retainer ring slot to accomplish the same purpose would need a minimum radial depth of about 0.100 in. and provide only a single engagement face. Hence, the buttress threads require only 0.034 in. material strength loss on the diameter whereas a C-ring slot may require 0.200 in.: a 0.166 in. advantage.

In sliding assembly along the mandrel outside surface are, for example, a debris barrier, packer seal elements and position anchors. These sliding elements are preferably displaced by some form of sliding force actuator such as hydraulic piston elements. There are numerous design options for suitable fluid power applications. The particular arrangement selected for the present invention, however, compresses the sliding elements between a sleeve ram 40 and the lower abutment ridge 47 on the mandrel. With respect to FIGS. 1B, 1C and 1D, a sleeve ram 40, having a close sliding fit around the mandrel O.D. above the mandrel piston 16, is in fixed, threaded assembly by threads 41 with an upper cylinder wall 30. The inside diameter surface of the upper cylinder wall 30 has a sliding seal fit with the O.D. of the mandrel piston 16. At its lower end, the upper cylinder wall 30 has a threaded assembly by threads 31 with a lower piston 26. The lower end of the upper cylinder wall 30 is also secured to the upper end of the lower cylinder wall 20 by means of a calibrated shear fastener 33. The lower piston 26 has a sliding seal fit relationship within the annular space 24 to provide a power cylinder displacement force against the end of the piston 26 by fluid pressure admitted from the mandrel bore through the orifice 22.

Figures 1B, 2B, 3B:
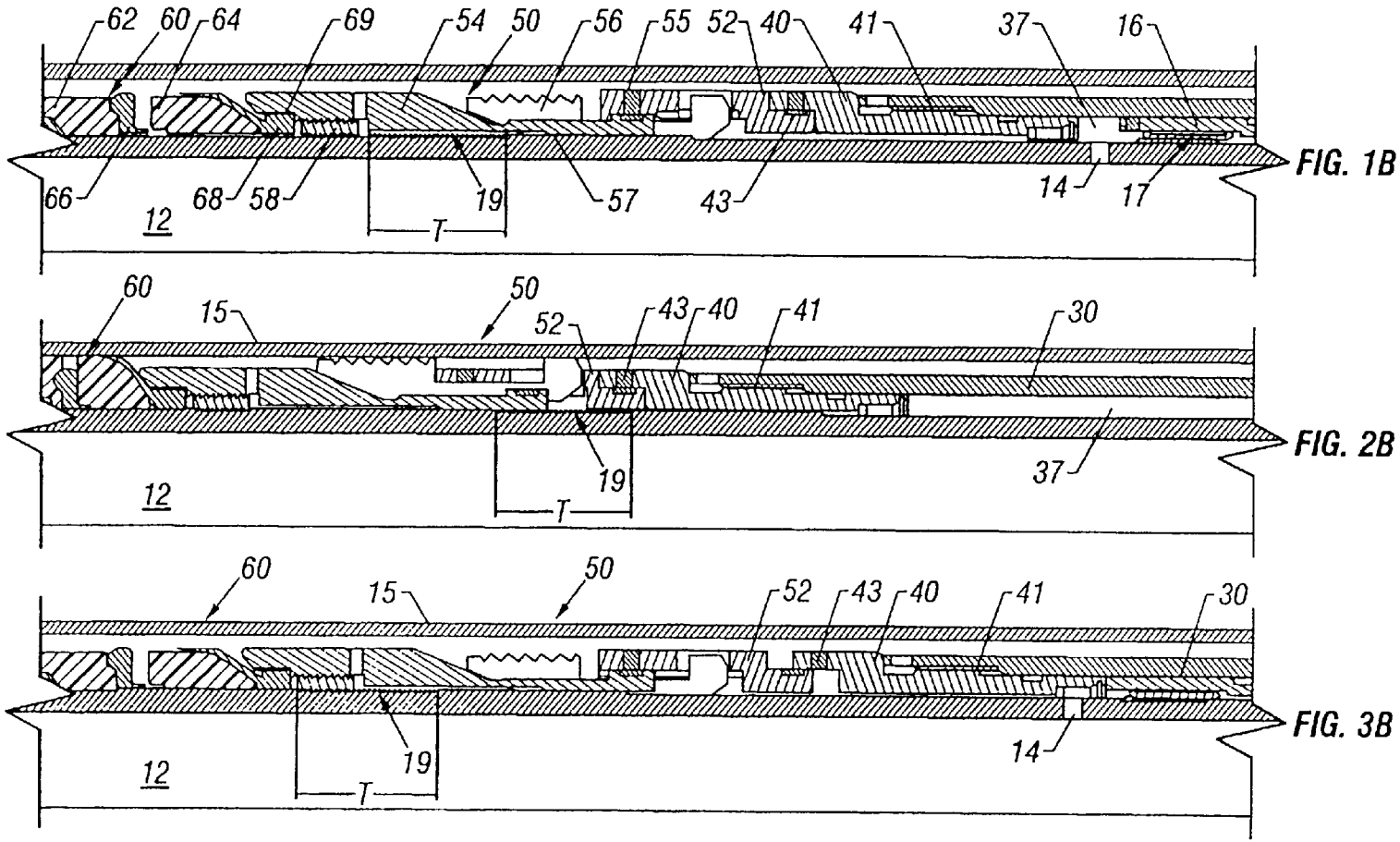
Figures 1C, 2C, 3C:
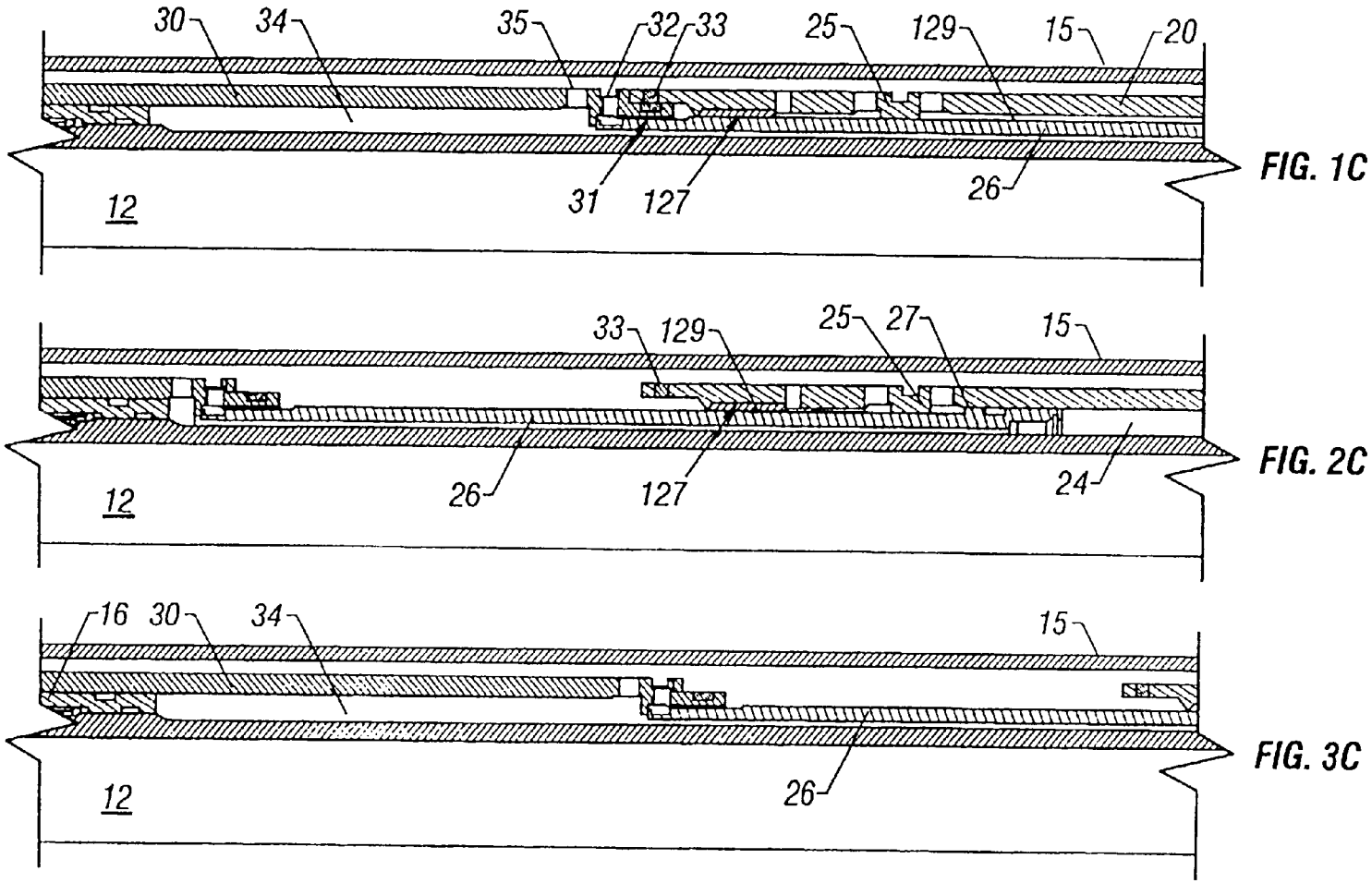
Figures 1D, 2D, 3D:
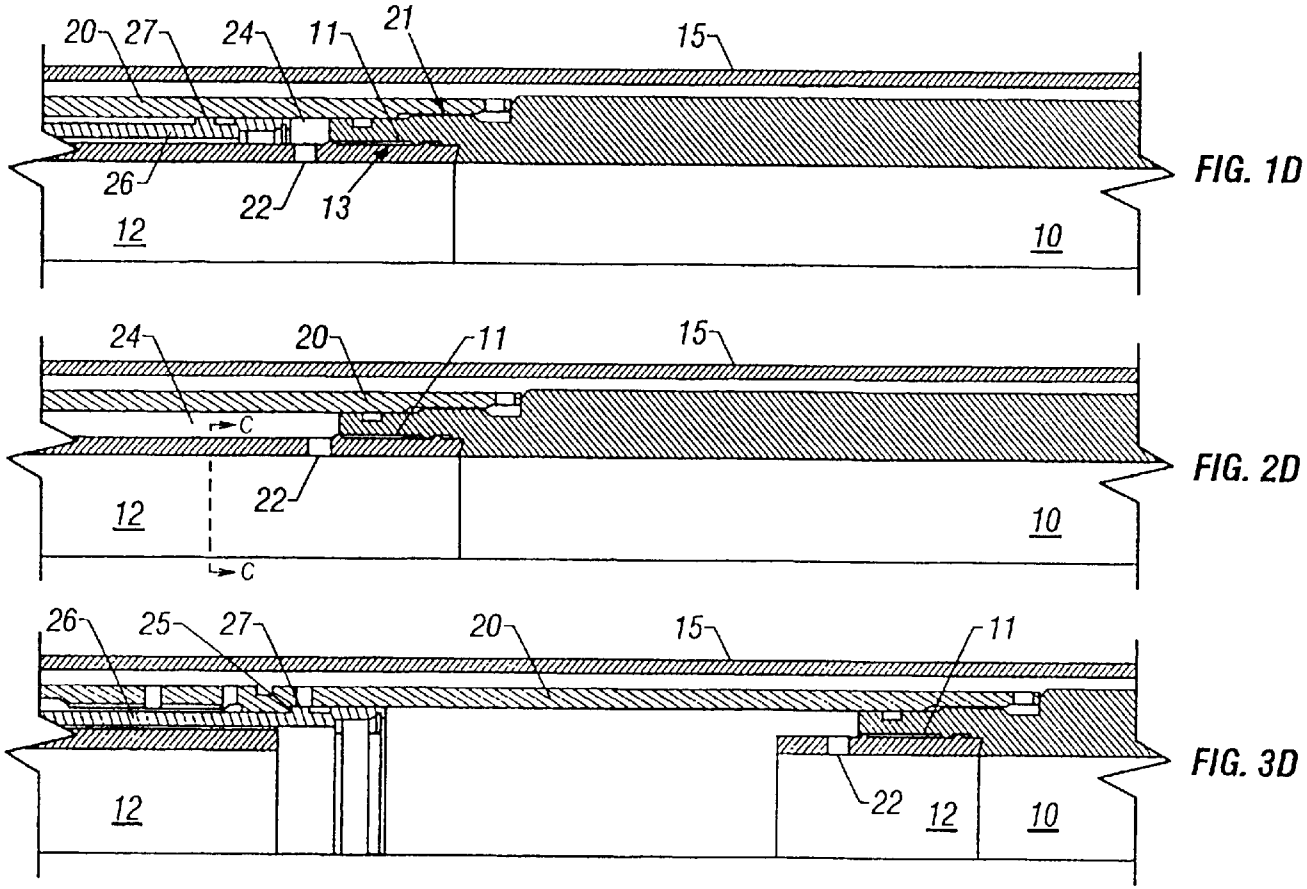
Figure 8:
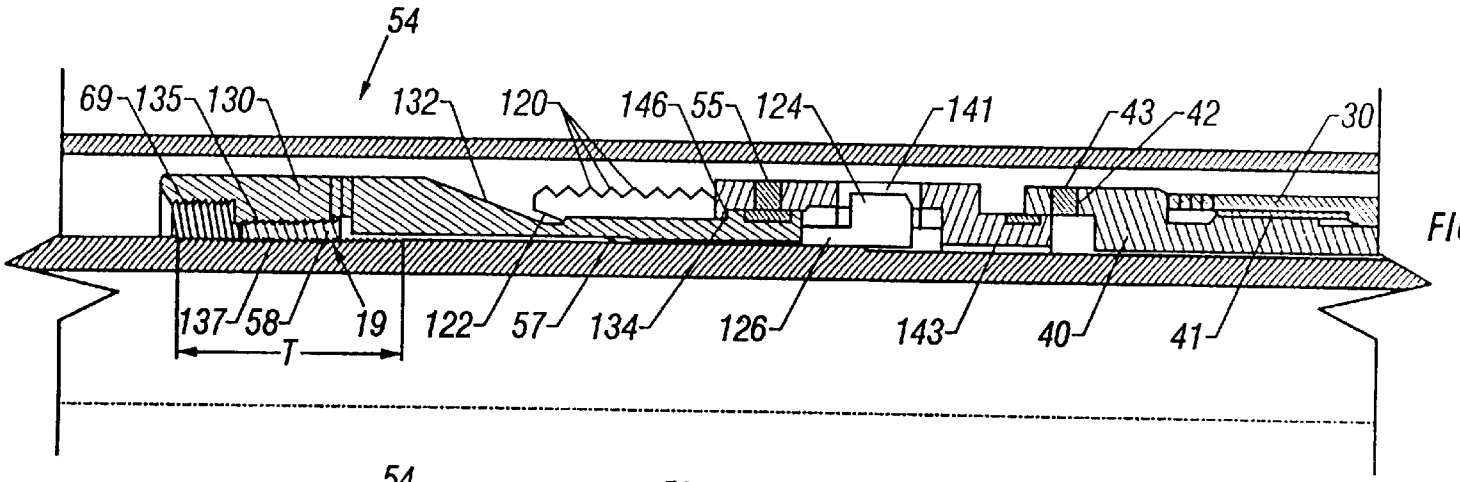
FIG. 8 is an enlarged, quarter section detail of the present well tool lower anchor in the anchor-release assembly state.

With respect to FIGS. 1B and 8, the sleeve ram 40 abuts the lower anchor mechanism 50. The lap sleeve 42 of the ram 40 overlays the lap sleeve 143 of a slip shoe retainer cage 52. The lapping sleeves 42 and 143 are secured together structurally by calibrated shear pins 43.

Figure 4:
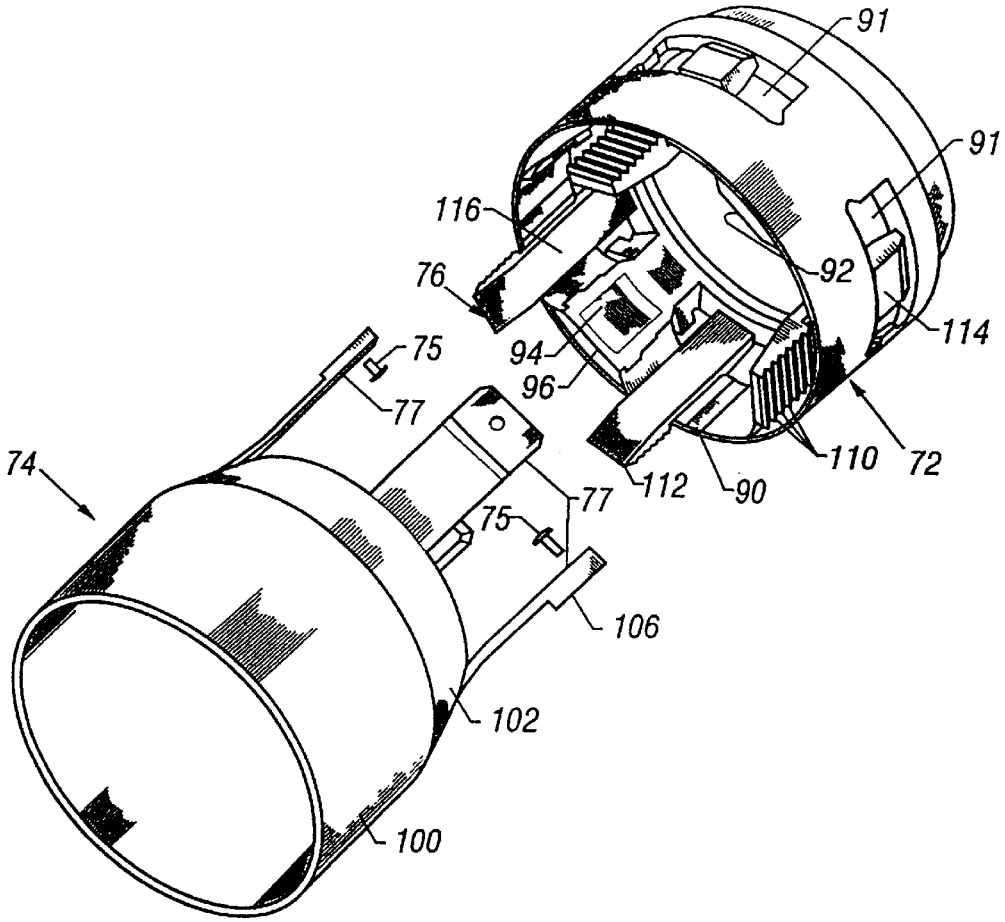
FIG. 4 is an exploded pictorial of the present well tool anchor.
Figure 5:
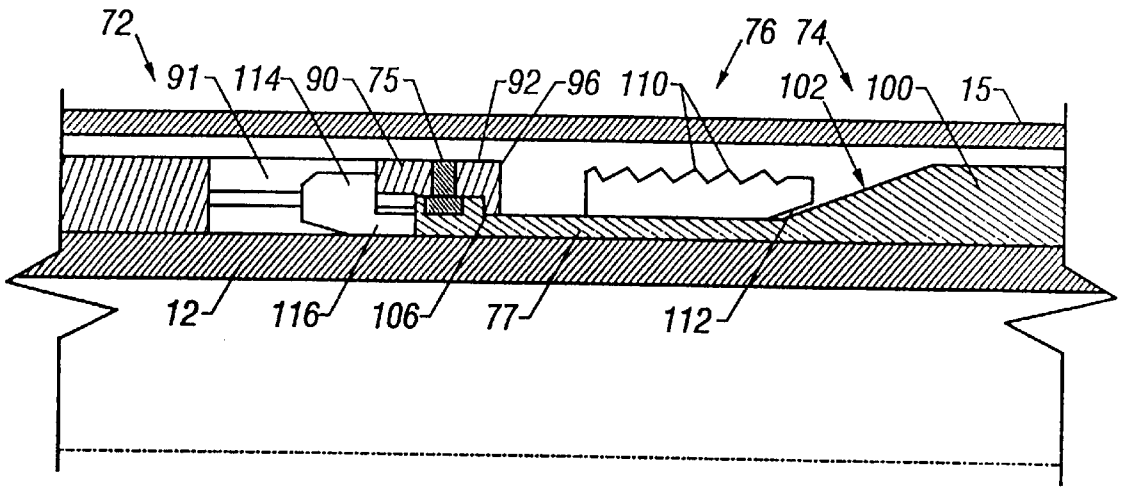
FIG. 5 is an enlarged, quarter section detail of the present well tool upper anchor in the run-in assembly state.
Figure 6:
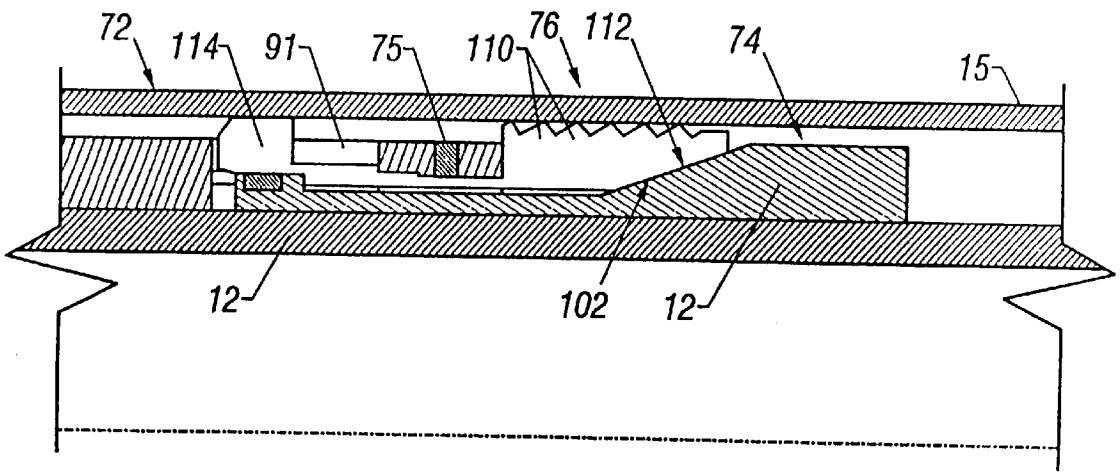
FIG. 6 is an enlarged, quarter section detail of the present well tool upper anchor in the set assembly state.

The lower tubular anchor mechanism 50 is illustrated in detail by FIGS. 7 through 11 as well as FIG. 1B. Four basic components of the mechanism include the slip shoe retainer cage 52, the collet cone 54, the wicker shoe 56 and the calibrated shear fasteners 43. The lower slip shoe retainer cage 52 is substantially identical to the upper slip shoe retainer cage 72 illustrated pictorially by FIG. 4. Correspondently, the lower cage 52 is a tubular element having a plurality of retainer slots 141 distributed around the perimeter: four slots, for example. Between the slots are collet bosses 142 having detent pockets defined within perimeter walls 146. The ends of the collet bosses are rigidified by circumferential webs 140.

Figure 9:
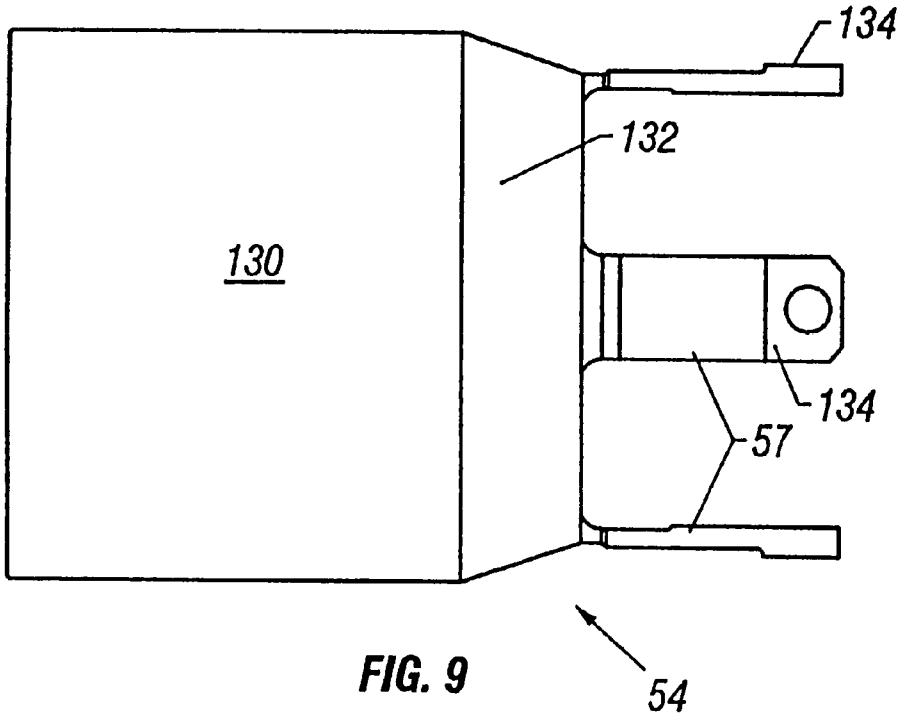
FIG. 9 is an elevation view of the well tool anchor setting sleeve.
Figure 11:
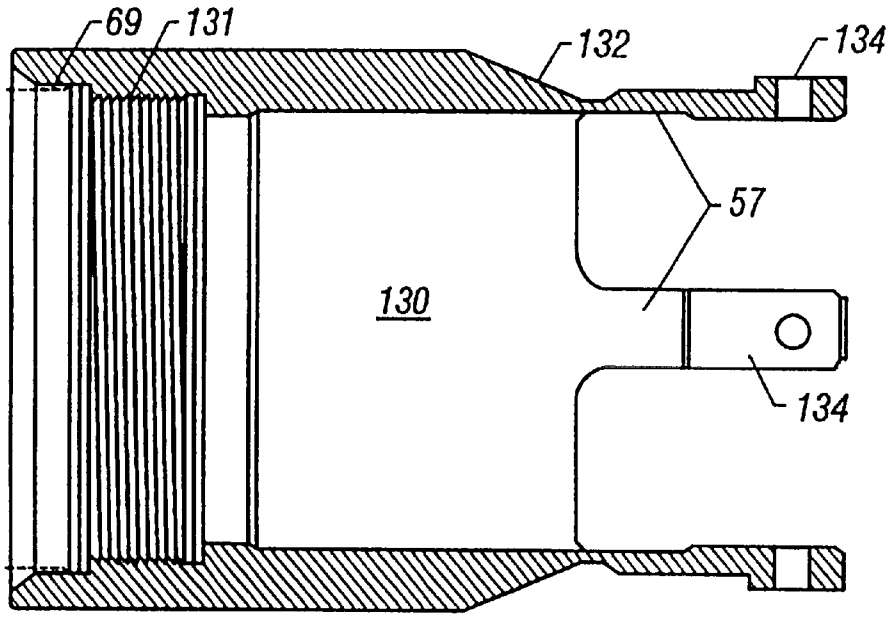
FIG. 11 is an axial section view of the lower well tool anchor setting sleeve along cutting plane 11—11 of FIG. 10.

The lower collet cone 54 includes a basic sleeve section 130 that tapers along a conical slip face 132 to the base of collet fingers 57 as clearly shown by FIGS. 9 and 11. The distal ends of the collet fingers have integral retainer blocks 134 that mesh with detents on the retainer cage. The retainer cage detents are defined by retainer walls 146 that circumscribe the detent area. For well run-in, the collet fingers are positioned to mesh the retainer blocks 134 with the detent areas of the retainer cage 52 and secured by calibrated shear fasteners 55. The longitudinal dimension of the detent area is greater than that of the collet finger blocks for several reasons. First, sufficient finger block displacement clearance along the detent is necessary to accommodate a shear failure of the fastener 55. Additionally, the geometry of the slip slope and the required radial displacement of the wicker shoes are essential design factors. Peripheral confinement of the retainer blocks 134 by the retainer walls 146 prevents complete disassembly.

Figure 7:
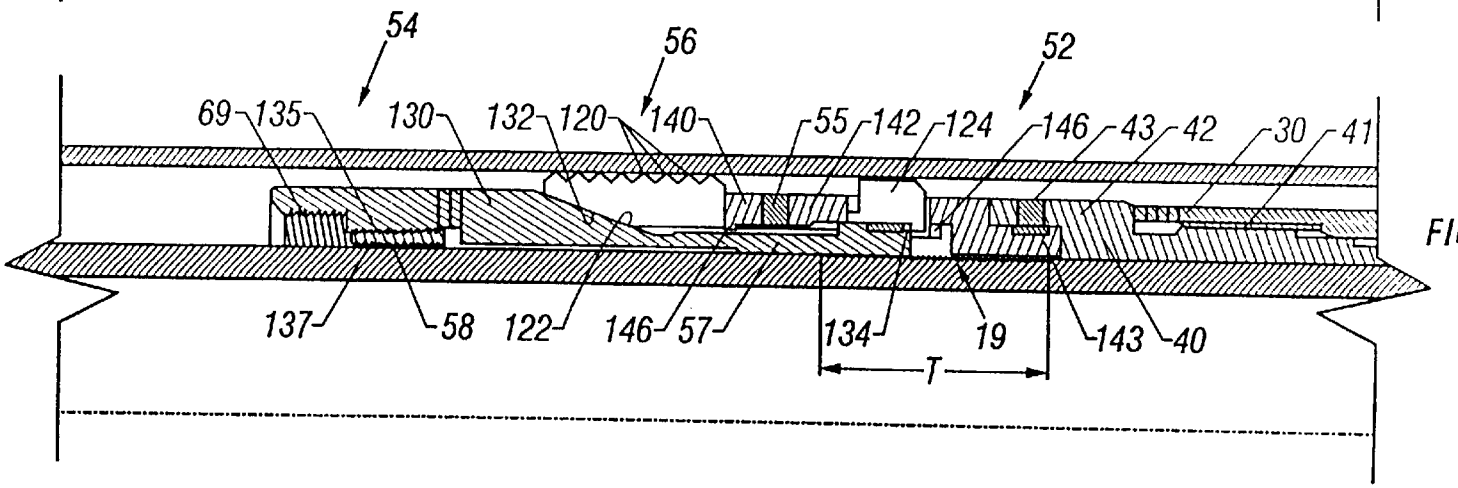
FIG. 7 is an enlarged, quarter section detail of the present well tool lower anchor in the anchor-set assembly state.
Figure 10:
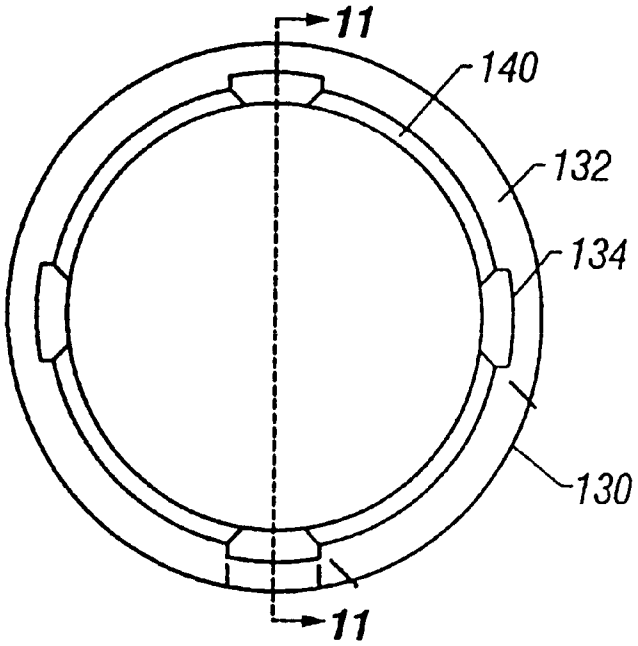
FIG. 10 is an end elevation view of the well tool anchor setting sleeve.

The wicker shoes 56, shown by FIGS. 1B, 7 and 8, are meshed loosely between the collet fingers 57 with the slip face 122 juxtaposed against the collet cone slip face 132. The wicker shoe retainer block 124 is meshed loosely within the cage retainer slot 141 and the wicker shoe strap 126 extends between the mandrel 12 and the circumferential web 140 of the retainer cage. The wicker shoes are substantially immobile laterally but have free movement, to a limit, radially.

With respect to FIG. 11, the upper end of the collet cone sleeve 130 carries first, assembly threads 69 for assembly with the packer end cups 68. Along a deeper counterbore from the sleeve end, internal buttress threads 131 are cut to mesh with cooperating external threads 135 on the body lock ring 58.

Figure 13:
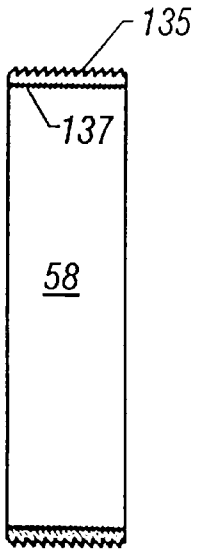
FIG. 13 is an axial section of the body lock ring element of the lower well tool setting sleeve along cutting plane 13—13 of FIG. 12.
Figure 12:
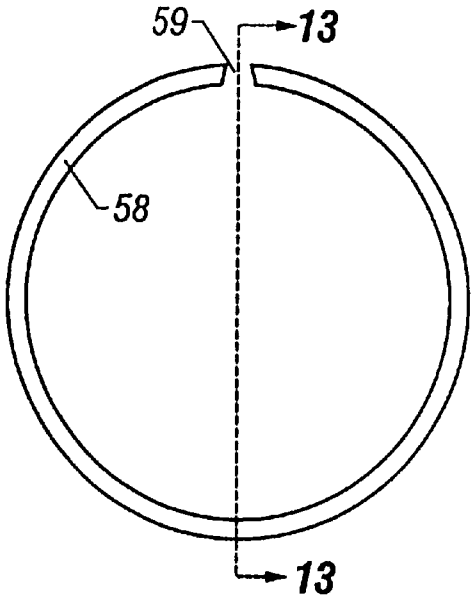
FIG. 12 is an end elevation view of the body lock ring element of the lower well tool setting sleeve.

The body lock ring 58, shown by FIGS. 12 and 13, also includes internal buttress threads 137 for meshing with the buttress threads 19 around the mandrel 12. The lock ring is also split as at 59 of FIG. 12 to facilitate radial collapse of the ring. Materially, the body lock ring 58 is resilient as needed to expand or contract circumferentially. When the collet sleeve 130 is sliding along the mandrel surface, the lock ring I.D. is less than when the lock ring buttress threads 137 are meshed with the mandrel buttress threads 19.

The sealing elements of the packer 60 are rubber or elastomer sleeves that are dimensionally compressed to seal the annular space between the mandrel 12 and the internal wall surface 15 of the well which may be production casing or raw, wellbore walls. In this case, there are three rubber sleeves including a center sleeve 62 that is separated longitudinally from a flanking pair of end sleeves 64 by stabilizer rings 66.

The collet cone 74 of the upper anchor 70 bears against the upper end cup 68 of the packer 60. With respect to FIGS. 1A, and 4 through 6, the collet cone 74 comprises a sleeve 100 having collet fingers 77 projecting longitudinally from the base of a conical slip face 102. Retainer blocks 106 on the distal ends of the fingers 77 are meshed with the detents 84 in the bosses 92 of the upper cage ring 72. The detents are defined by the perimeter wall 96. The retainer blocks 106 are secured in meshed assembly with the cage detents 94 by shear fasteners 75. The bosses 92 of the upper cage ring are laterally spaced by circumferential webs 90. Approximately mid-length of the cage ring are four slots 91, for example. Similar to the lower anchor 50, the straps 116 of wicker shoes 76 mesh loosely under the cage web 90 with the shoe retainer block 114 meshed within the retainer slots 91 and the shoe slip face 112 juxtaposed with the conical slip face 102.

The upper end of the upper cage ring 72 overlies the abutment ridge 47 that is a fixed reference point along the length of the mandrel. A compression collar element 88 of the debris barrier 80 is secured to the cage ring 72 by assembly threads 89. The cage ring 72 is axially slidable over the limit ring 45 between upper and lower abutments 48 and 49.

The anchor collar element 84 of the debris barrier 80 is secured to the mandrel 12 surface by assembly threads 86. Secured between the anchor collar and the compression collar is an elastomer or rubber sleeve 82 that expands radially when the two collars are force together.

The tool is lowered into a well in the mechanical status as described above with respect to FIGS. 1A through 1D. When located at the desired set position, the center bore of the mandrel 12 is pressurized from the surface with working fluid, which may, for example, be hydraulic oil or drilling fluid. Entering the expansion chambers 24 and 37 through the pressure orifices 22 and 14, respectively, the lower piston 26 and sleeve ram 40 are displaced upwardly along the mandrel 12 by first shearing the fastener 33 between the lower cylinder wall 20 and the upper cylinder wall 30. This initial movement is transferred along and through all of sliding elements of the tool to the compression collar 88 of the debris barrier 80 to first, extend the barrier sleeve 82 radially against the well wall.

When the abutment wall 49 engages the lower edge of the abutment ridge 47, loading stress is focused upon the remaining shear fasteners. Fastener 75 between the upper anchor cage 72 and the collet finger 77 is calibrated as the second weakest fastener and fails next thereby allowing the upper anchor to collapse axially and the conical slip face 102 to be driven under the wicker shoe slip face 112. Consequently, the wicker shoe 76 is displaced radially to drive the wickers 110 into the well wall 15.

As the upper anchor 70 is set, the packer sealing element 62 and 64 are compressed between the upper and lower collet sleeves and also expanded against the well wall 15. The internal buttress threads 137 on the body lock ring 58 are not initially engaged with the corresponding threads 19 on the mandrel O.D. surface. Consequently, the lower collet cone 54 may be displaced along the mandrel surface to load compressively against the packer 60 until the calibrated shear force of fastener 55 is overcome. At that moment, the upper edge of the circumferential web 140 portion of the cage ring 52 engages the base of the wicker shoe to force the wicker shoe slip face 122 upon the conical slip face 132 thereby expanding the wicker radially until the wicker teeth 120 penetrate the well wall 15. Engagement of the buttress threads on the body lock ring 127 attached to the upper end of the lower cylinder wall 20 with the external buttress threads 129 on the lower piston 26 irreversibly secures the relative position. This completes the packer tool setting.

Removal of the tool from the well essentially requires the same sequence of that followed when setting the tool. Specifically, the debris barrier 80 and the upper anchor 70 is released followed by release of the packer seals 60. Upon release of the packer seals, the lower anchor 50 is released.

The foregoing sequence is initiated by cutting the mandrel 12 in the approximate region of the cut line C—C illustrated by FIG. 2D. This cut through the mandrel 12 tube into the lower cylinder space 24 between the upper end of the work string box sleeve 11 and the lower end of the lower piston 26 may be accomplished by any of several well known wireline tools.

Following the mandrel 12 severance at C—C, tension is drawn on the mandrel 12 from the surface along the upper workstring to lift the mandrel relative to the packer and anchors. Predominantly, the mandrel slides under the packer and anchors. The anchor collar 84 for the debris barrier is secured to the mandrel 12 by threads 86. Consequently, the anchor collar 84 moves with the mandrel 12 and pulls on the barrier sleeve 82 to retract it from the well wall.

As the barrier sleeve 82 reaches its extended limit, the upper abutment ridge 46 on the mandrel engages the abutment wall 48 on the compression collar 88. Since the compression collar is assembled by threads 89 to the upper cage ring 72, the connection with the upper cage ring draws the lower face of the retainer slot 91 against the upper wicker shoe retainer block 114. This connection with the upper cage ring draws the lower face of the retainer slot 91 against the upper wicker shoe retainer block 114. Additional pull of the mandrel after this engagement pulls the upper wicker shoe slip face 112 away from the conical slip face 102 of the upper collet cone 74 thereby disengaging the wickers 110 from the well wall 15. The upper anchor 70 is now released.

At this point, retainer wall 96 on the upper cage ring has also engaged the retainer block 106 on the upper collet fingers 77. Accordingly, after the wicker shoes are pulled away from the collet cone, the collet cone 74 and upper end cup 68 is pulled away from the packer 60 sealing sleeves. This removes the seal supporting compression on the sealing sleeves thereby withdrawing the packer.

Near the expanded limit of the foregoing train of connections, the buttress thread section T of the mandrel is pulled into engagement with the inner buttress threads 137 on the body lock ring 58. This engagement pulls the conical slip face 132 on the lower collet sleeve 130 away from the lower wicker shoe slip face 122 thereby disengaging the lower wickers 120 from the well wall 15.

When the lower anchor 50 is released, the entire weight of the lower work string 10 is transferred to the lower anchor assembly via the upper cylinder wall 30, the sleeve ram 40 to the cage ring 52. Given the limited support surface of these components, prudence suggest that the lower workstring weight should be shifted to more substantial structure. To this end, the retainer wall 146 on the lower cage ring 52 engages the retainer block 134 on the lower collet finger 57. This engagement provides a structural loading train between the buttress threads 19 on the mandrel to the calibrated shear fastener 43 sleeve ram 40 and the lap sleeve 143 on the cage ring 52. If the lower workstring weight is sufficient to shear the calibrated fasteners 43, the workstring weight load is shifted to mandrel piston 16.

All elements of the tool assembly are now released from the well wall 15 thereby permitting the workstring 10 to be removed from the well or repositioned to a different depth.

Although the invention has been described in terms of specified embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the scope of the claimed invention.

What is claimed is:

1. A well tool anchor comprising:

(a) a substantially tubular wicker shoe cage for independent axial translation along a tubular mandrel;

(b) a substantially tubular wicker engagement sleeve for independent axial translation along said tubular mandrel, said sleeve having a substantially conical slip face and a plurality of structural finger projections;

(c) a plurality of wicker shoes having pipe wall penetration wickers and a slip face; and, (d) a meshed coupling of said shoe cage with said sleeve finger projections secured by a calibrated failure fastener whereby an axial translation of said sleeve toward said shoe cage translates said wicker shoes radially outward and an axial translation of said shoe cage away from said sleeve translates said wicker shoes radially inward.

2. A well tool anchor as described by claim 1 wherein said engagement sleeve is meshed with said shoe cage and wicker shoes to align said wicker shoe slip face in juxtaposition with said conical slip face.

3. A well tool anchor as described by claim 2 wherein a meshed alignment of said wicker shoes with said shoe cage substantially limits movement of said wicker shoes to radial displacement.

4. A well tool anchor as described by claim 2 wherein the meshed alignment of said finger projections with said shoe cage comprises a detent area of said shoe cage to limit axial disassembly of said engagement sleeve from said shoe cage.

5. A well tool anchor as described by claim 1 having a tubular mandrel for slidably aligning said shoe cage and engagement sleeve.

6. A well tool anchor comprising:

(a) a substantially tubular tool mandrel;

(b) a substantially tubular wicker shoe cage having a sliding alignment along said mandrel;

(c) a substantially tubular wicker engagement sleeve having a sliding alignment along said mandrel, a substantially conical slip face and a plurality of longitudinally projecting fingers;

(d) a plurality of wicker shoes, each having a pipe wall penetration wicker across an outer face thereof; and, (e) a plurality of calibrated failure fasteners for securing said finger projections to said shoe cage in meshed alignment therewith whereby said wicker shoes are confined between said mandrel, said shoe cage and said engagement sleeve.

7. A well tool anchor as described by claim 6 wherein said wicker shoes have a slip face that is juxtaposed with said conical slip face when confined between said mandrel, said shoe cage and said engagement sleeve.

8. A well packer comprising:

(a) a substantially tubular mandrel;

(b) a deformable sleeve element around said mandrel;

(c) an axial force actuator secured to said mandrel; and, (d) a well position anchor around said mandrel between said deformable sleeve and said force actuator, said anchor having a setting sleeve, a wicker shoe cage and a plurality of wicker shoes, said setting sleeve having a meshed alignment with said shoe cage to confine said wicker shoes therebetween, said alignment being secured by calibrated failure fasteners.

9. A well packer as described by claim 8 wherein said wicker shoes and setting sleeve have respectively juxtaposed slip faces.

10. A well packer as described by claim 9 comprising a well position anchor on axially opposite sides of said deformable sleeve.

11. A well packer as described by claim 10 wherein the shoe cage respective to the position anchor opposite from said force actuator is restrained from axial translation along said mandrel whereby an axial extension of said force actuator radially extends said wicker shoes and said deformable sleeve element.

12. A method of releasably anchoring a well tool to a well wall comprising the steps of:

(a) providing a tubular mandrel member;

(b) slidably placing axially compressed packer seal elements over said tubular mandrel member;

(c) positioning compressively engaged anchoring members along said mandrel on axially opposite sides of said seal elements, said anchoring members having a plurality of wicker shoes confined within a meshed assembly of first and second tubular elements whereby said first tubular elements are most remote from said packer seal elements, said meshed assembly being secured by calibrated failure fasteners between said first tubular element and projections from said second tubular element;

(d) restraining the axial translation of the first tubular element on one side of said packer seal element relative to said mandrel member;

(e) axially translating the first tubular element of the other side of said packer seal elements toward the first tubular element on the one side by defeating said calibrated fasteners to radially extend said wicker shoes and said packer seal elements; and, (f) axially translating the first tubular element on the one side of said packer seal elements from the first tubular element on the one side to radially retract said wicker shoes and packer seal elements.

13. A method as described by claim 12 wherein said wicker shoes respective to the anchoring member on the one side of said packer seal elements are extended prior to the extension of said packer seal elements and said wicker shoes respective to the anchoring member on the other side of said packer seal elements are extended after the extension of said packer seal elements.

* * * * *

UNITED STATES PATENT AND TRADEMARK OFFICE

CERTIFICATE OF CORRECTION

PATENT NO. : 6,715,560 B2 
DATED : April 6, 2004
INVENTOR(S) : James Christopher Doane, Hector Hugo Mireles and Conrad Gustave Weinig It is certified that error appears in the above-identified patent and that said Letters Patent is hereby corrected as shown below:

Title page,
Item [75], Inventors, the last name of the third inventor reads "Weining." and should read -- Weinig. --

Signed and Sealed this

Fifteenth Day of June, 2004

JON W. DUDAS
*Acting Director of the United States Patent and Trademark Office*